US011713618B2

(12) United States Patent
Hummel et al.

(10) Patent No.: US 11,713,618 B2
(45) Date of Patent: Aug. 1, 2023

(54) FOLLOWER ARRANGEMENT FOR A BLIND ASSEMBLY

(71) Applicant: ODL, Incorporated, Zeeland, MI (US)

(72) Inventors: Ben Hummel, Rockford, MI (US); Stacy Grant Frye, Zeeland, MI (US); Sharlene Kluchinsky Clark, Holland, MI (US); Rachel DeGraaf, Grandville, MI (US); Keith Philip Leyendecker, Hudsonville, MI (US); Caroline Spytman, Boyne City, MI (US); Mark R. Elgersma, Holland, MI (US)

(73) Assignee: ODL, Incorporated, Zeeland, MI (US)

( * ) Notice: Subject to any disclaimer, the term of this patent is extended or adjusted under 35 U.S.C. 154(b) by 119 days.

(21) Appl. No.: 17/495,878

(22) Filed: Oct. 7, 2021

(65) Prior Publication Data

US 2022/0112763 A1 Apr. 14, 2022

Related U.S. Application Data

(60) Provisional application No. 63/089,311, filed on Oct. 8, 2020.

(51) Int. Cl.

| | |
|---|---|
| ***E06B 9/264*** | (2006.01) |
| ***E06B 9/322*** | (2006.01) |
| ***E06B 9/62*** | (2006.01) |
| ***E06B 9/266*** | (2006.01) |

(52) U.S. Cl.

CPC ..... *E06B 9/322* (2013.01); *E06B 9/264* (2013.01); *E06B 9/266* (2013.01); *E06B 9/62* (2013.01); *E06B 2009/2643* (2013.01); *E06B 2009/2646* (2013.01)

(58) Field of Classification Search

CPC ..... E06B 9/322; E06B 9/264; E06B 9/266; E06B 9/62; E06B 2009/3222; E06B 2009/2643; E06B 2009/2646

See application file for complete search history.

(56) References Cited

U.S. PATENT DOCUMENTS

| | | | | |
|---|---|---|---|---|
| 4,588,012 A * | 5/1986 | Anderson | E06B 9/264 | 160/174 R |
| 6,601,633 B2 * | 8/2003 | Sun | E06B 9/264 | 160/176.1 R |
| 7,475,715 B2 * | 1/2009 | Gardner | E06B 9/264 | 160/107 |
| 7,669,633 B2 * | 3/2010 | Berger | E06B 9/30 | 160/107 |
| 8,499,815 B2 * | 8/2013 | Zhang | E06B 9/322 | 160/176.1 R |

(Continued)

*Primary Examiner* — Johnnie A. Shablack

(74) *Attorney, Agent, or Firm* — Barnes & Thornburg LLP

(57) ABSTRACT

A follower arrangement, operatively coupled to a plurality of slats of a blind assembly via a flexible cord, for raising and lowering the plurality of slats via the flexible cord, may include a housing defining a first opening therethrough, a ferromagnetic or paramagnetic counterweight to act against a weight of the plurality of slats of the blind assembly to reduce forces required to be applied to the follower arrangement to raise or lower the slats, and at least one magnet received within the first opening defined through the housing and magnetically attached to the counterweight to magnetically secure the housing to the counterweight.

20 Claims, 7 Drawing Sheets

(56) References Cited

U.S. PATENT DOCUMENTS

| | | | | |
|---|---|---|---|---|
| 8,550,141 | B2 * | 10/2013 | Ding | E06B 9/264 160/176.1 R |
| 8,616,260 | B2 * | 12/2013 | Zhang | E06B 9/264 160/170 |
| 9,121,220 | B2 * | 9/2015 | Zhang | E06B 9/264 |
| 9,410,364 | B1 * | 8/2016 | Zheng | E06B 9/322 |
| 10,876,353 | B2 * | 12/2020 | Hummel | E06B 9/264 |
| 11,293,219 | B2 * | 4/2022 | Zhang | E06B 9/264 |
| 11,492,846 | B2 * | 11/2022 | Huang | E06B 9/322 |
| 2006/0118250 | A1 * | 6/2006 | Jin | E06B 9/264 160/107 |
| 2008/0029226 | A1 * | 2/2008 | Huang | E06B 9/264 160/107 |
| 2008/0083511 | A1 * | 4/2008 | Hung | E06B 9/32 160/168.1 R |
| 2008/0283200 | A1 * | 11/2008 | Hummel | E06B 9/264 160/90 |
| 2011/0036510 | A1 * | 2/2011 | Jin | H01F 7/0242 335/229 |
| 2014/0020851 | A1 * | 1/2014 | Ouzts | E06B 9/264 160/127 |
| 2022/0112763 | A1 * | 4/2022 | Hummel | E06B 9/322 |

* cited by examiner

FOLLOWER ARRANGEMENT FOR A BLIND ASSEMBLY

CROSS-REFERENCE TO RELATED APPLICATIONS

This application claims the benefit of and priority to U.S. Provisional Patent Application Ser. No. 63/089,311, filed Oct. 8, 2020, the disclosure of which is expressly incorporated herein by reference in its entirety.

TECHNICAL FIELD

The present disclosure relates generally to followers for magnetically actuated blind assemblies disposed between opposing panels, and further to followers with which at least one counterweight is implemented to reduce forces required to operate such blind assemblies.

BACKGROUND

Blind assemblies disposed between opposing panels of conventional insulated glass (IG) units are known. Some such assemblies utilize magnetic actuating arrangements for operating the blind assemblies; e.g., to raise and lower the blind assemblies and/or to rotate the blind slats between open and closed positions. In some implementations, e.g., in which the opposing panels have a substantial length and/or width, substantial forces may be required to operate the blind assemblies. In such implementations, one or more counterweights may be employed to reduce the forces required to operate the blind assemblies.

SUMMARY

The present disclosure may comprise one or more of the features recited in the attached claims, and/or one or more of the following features and combinations thereof. In one aspect, a follower arrangement, operatively coupled to a plurality of slats of a blind assembly via a flexible cord, for raising and lowering the plurality of slats via the flexible cord, may comprise a housing defining a first opening therethrough, a ferromagnetic or paramagnetic counterweight to act against a weight of the plurality of slats of the blind assembly to reduce forces required to be applied to the follower arrangement to raise or lower the slats, and at least one magnet received within the first opening defined through the housing and magnetically attached to the counterweight to magnetically secure the housing to the counterweight.

In another aspect, a panel assembly may comprise first and second spaced apart panels, a spacer affixed to inner surfaces of each of the first and second panels about a periphery of the first and second panels to define an air space bounded by the spacer and the first and second panels, a blind assembly, including a plurality of blind slats, disposed within the air space and operatively coupled to the spacer, a flexible cord operatively coupled to the blind assembly for raising and lowering the plurality of blind slats, and the follower arrangement, as described in the previous paragraph, operatively coupled to the flexible cord.

In yet another aspect, a follower arrangement, operatively coupled to a blind assembly via a flexible cord, for raising and lowering a plurality of slats of the blind assembly via the flexible cord, may comprise a housing defining a first opening therethrough, at least one retaining wall disposed over at least a portion of the first opening, a counterweight to act against a weight of the plurality of slats of the blind assembly to reduce forces required to be applied to the follower arrangement to raise or lower the slats, and at least one retaining member received within the first opening defined through the housing and abutting the at least one retaining wall, the at least one retaining member attached to the counterweight to secure the housing between the retaining member and the counterweight.

DESCRIPTION OF THE ILLUSTRATIVE EMBODIMENTS

Figure 3:
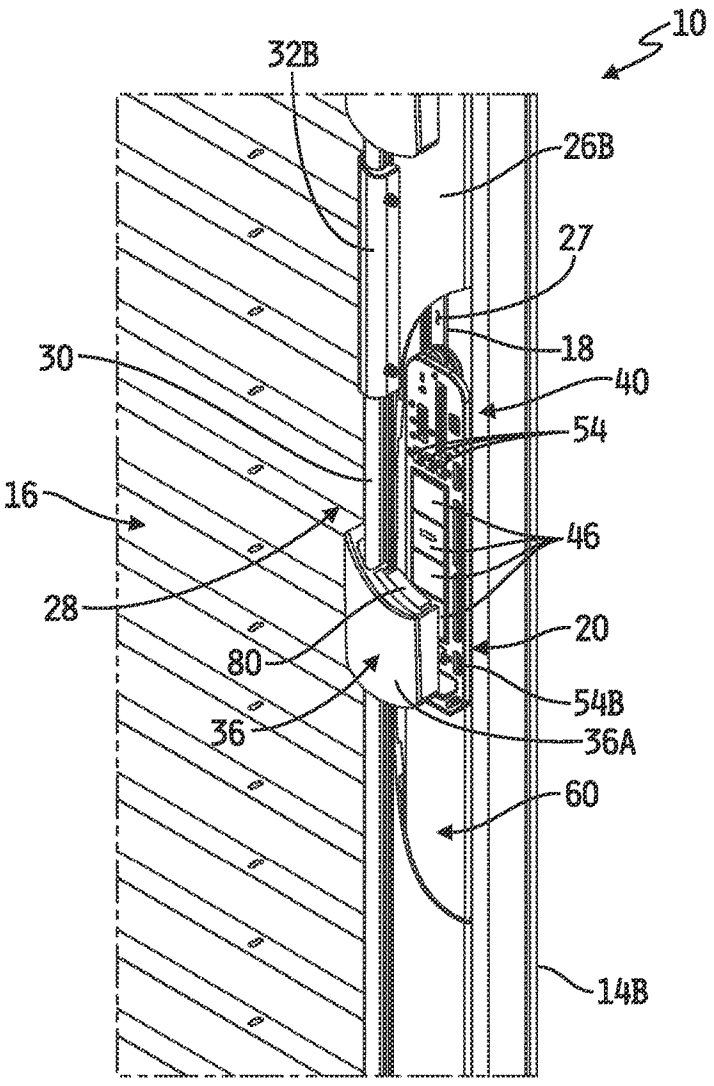
FIG. 3 is a partial cutaway view of the portion M of the panel unit of FIG. 1A illustrating operation of the follower assembly of FIGS. 2A-2E using a conventional operator assembly.

For the purposes of promoting an understanding of the principles of this disclosure, reference will now be made to a number of illustrative embodiments shown in the attached drawings and specific language will be used to describe the same.

This disclosure relates to followers and/or follower assemblies for magnetically actuated blind assemblies disposed between opposing panels, with which at least one counterweight is implemented to reduce forces required to operate such blind assemblies. Referring now to FIGS. 1A-1D, an embodiment is shown of a panel assembly 10 in which an embodiment of a follower assembly 20, including a counterweight, is shown. In the illustrated embodiment, the panel assembly 10 includes a pair of opposed panels 12A, 12B each having inner planar surfaces to which a conventional spacer 14 is attached about the periphery of each panel 12A, 12B in a conventional manner. Illustratively, the spacer 14 is positioned between and adhered to the inner surfaces of each of the panels 12A, 12B, and extends along and adjacent to the opposed top and bottom edges of the panels 12A, 12B as well as along and adjacent to the opposed side edges of the panels 12A, 12B as is conventional. An airspace 15 is defined between the panels 12A, 12B and bounded by the spacer 14.

In some embodiments, each panel 12A, 12B is illustratively made of glass, and in such embodiments the panels 12A, 12B and the spacer 14 to which the panels 12A, 12B are affixed are together sometimes referred to as a so-called "insulated glass" or IG unit. In some alternate embodiments, either of both of the panels 12A, 12B may be or include one or more alternate materials, examples of which include, but are not limited to, optically transparent or translucent polycarbonate, poly(methyl methacrylate), also known as PMMA or acrylic, or the like. In any such embodiment, either or both of the panels 12A, 12B may be or include multiple materials and/or may be or include one or more areas of transparency, one or more areas of translucence, one or more areas of opaqueness and/or one or more non-light transmissive areas. Each panel 12A, 12B is further illustrated in FIGS. 1A and 1B as including a single panel, although it will be understood that in alternate embodiments either or both of the panels 12A, 12B, may be or include two or more juxtaposed panels defining an air space therebetween and/or joined by one or more films, adhesives or the like. In some such alternative embodiments, two more spacers 14 may be used to separate the multiple panels, wherein each set of opposed panels is adhered to a respective spacer 14. In some embodiments, either or both of the panels 12A, 12B may have one or more coatings or films applied to either or both of the inner and outer planar surfaces thereof. Alternatively or additionally, one or more films and/or other structures may be positioned between the juxtaposed panels 12A, 12B. The IG unit may illustratively have any length and/or width, and/or have any geometrical configuration, and may be implemented as, or as part of, an openable window, a non-opening window, a door, a skylight or the like.

In the illustrated embodiment, elongated fasciae 26A-26D are provided, and each fascia 26A-26D is coupled, in a conventional manner, to an along an inner portion of a respective elongated member of the spacer 14 such that the fasciae 26A-26D are disposed within the airspace bounded by the spacer 14. For example, a top fascia 26A is coupled to a top, e.g., horizontally-disposed, member 14A of the spacer 14, side fasciae 26B, 26C are coupled to respective side, e.g., vertically-disposed, members 14B, 14C, and a bottom fascia 26D is coupled to a bottom, e.g., horizontally-disposed, member 14D of the spacer 14, as illustrated by example in FIGS. 1C and 1D. In the illustrated embodiment, the spacer 14 and the fasciae 26A-26D are configured such that outer edges of the fasciae 26A-26D snap into and between inner flanges of the spacer 14, as also illustrated by example in FIGS. 1C and 1D. In alternate embodiments, one or more of the fasciae 26A-26D may be coupled to a respective member of the spacer 14 using any conventional fastening structure(s) and/or any conventional bonding medium(s).

A blind assembly 16 is disposed within an airspace 15 defined between the panels 12A, 12B and is illustratively mounted to the top member 14A of the spacer 14. In the illustrated embodiment, for example, the blind assembly 16 includes a mounting assembly 16A having a retaining member 16C operatively coupled in a conventional manner to the top fascia 26A which is, as described above, mounted to the top, horizontally-disposed member 14A of the spacer 14. The blind assembly 16 further includes a plurality of slats 16B operatively coupled to the mounting assembly 16A via a plurality of conventional slat operating cords 16D, a flexible blind actuating cord 18 operatively coupled to the mounting assembly 16A, a magnetically-operated follower assembly 20 through which the cord 18 passes and a magnetically-operated tilt module assembly 22 coupled to one end of the cord 18. The mounting assembly 16A, the plurality of slats 16B, the blind actuating cord 18, the follower assembly 20 and the tilt module assembly 22 are all disposed within the airspace 15 defined between the panels 12A, 12B. A portion or portions of the flexible actuating cord 18 of the blind assembly 16 is/are operatively coupled to the mounting assembly 16A in a conventional manner, and a remaining portion of the cord 18 extends into an elongated channel 27 defined by and within the side fascia 26B as depicted by example in FIG. 1D. The mounting assembly 16A illustratively includes conventional components (not shown) responsive to actuation of the cord 18 to raise and lower the plurality of slats 16B and to adjust a tilt angle of the plurality of slats 16B between a fully open, e.g., substantially horizontal, position and either of two fully closed positions, e.g., rotated approximately 75 degrees forwardly from horizontal or rotated approximately 75 rearwardly from horizontal, as is conventional.

The cord 18, follower assembly 20 and tilt module assembly 22 are all movable along and within the channel 27 in a conventional manner. A magnetic stack latch assembly 24 is fixed in positioned within the channel 24 at or adjacent to the bottom fascia 26D, and the latch assembly 24 illustratively includes one or more magnets configured to magnetically engage the follower assembly 20 under certain operating conditions of the blind assembly 16 as will be described in greater detail below. The cord 18, follower assembly 20 and tilt module assembly 22 may together be referred to herein as a blind control assembly.

Figure 1A:
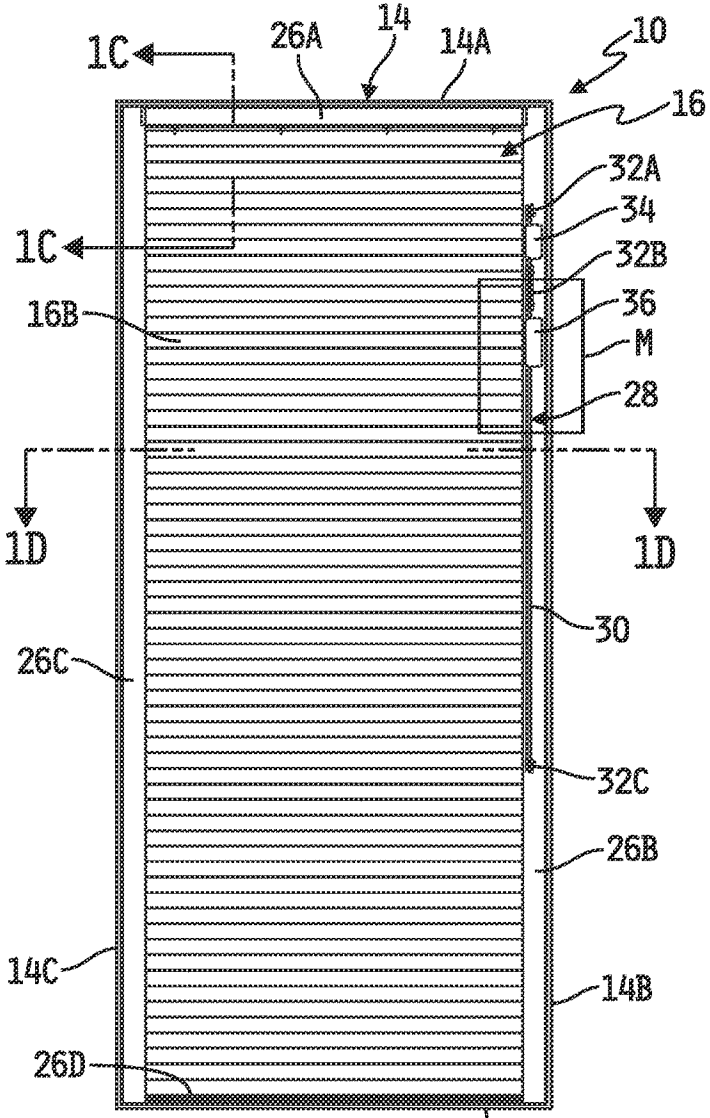
FIG. 1A is a front elevational view of an embodiment of a panel unit including a blind assembly disposed between opposing panels of the panel unit.
Figure 1B:
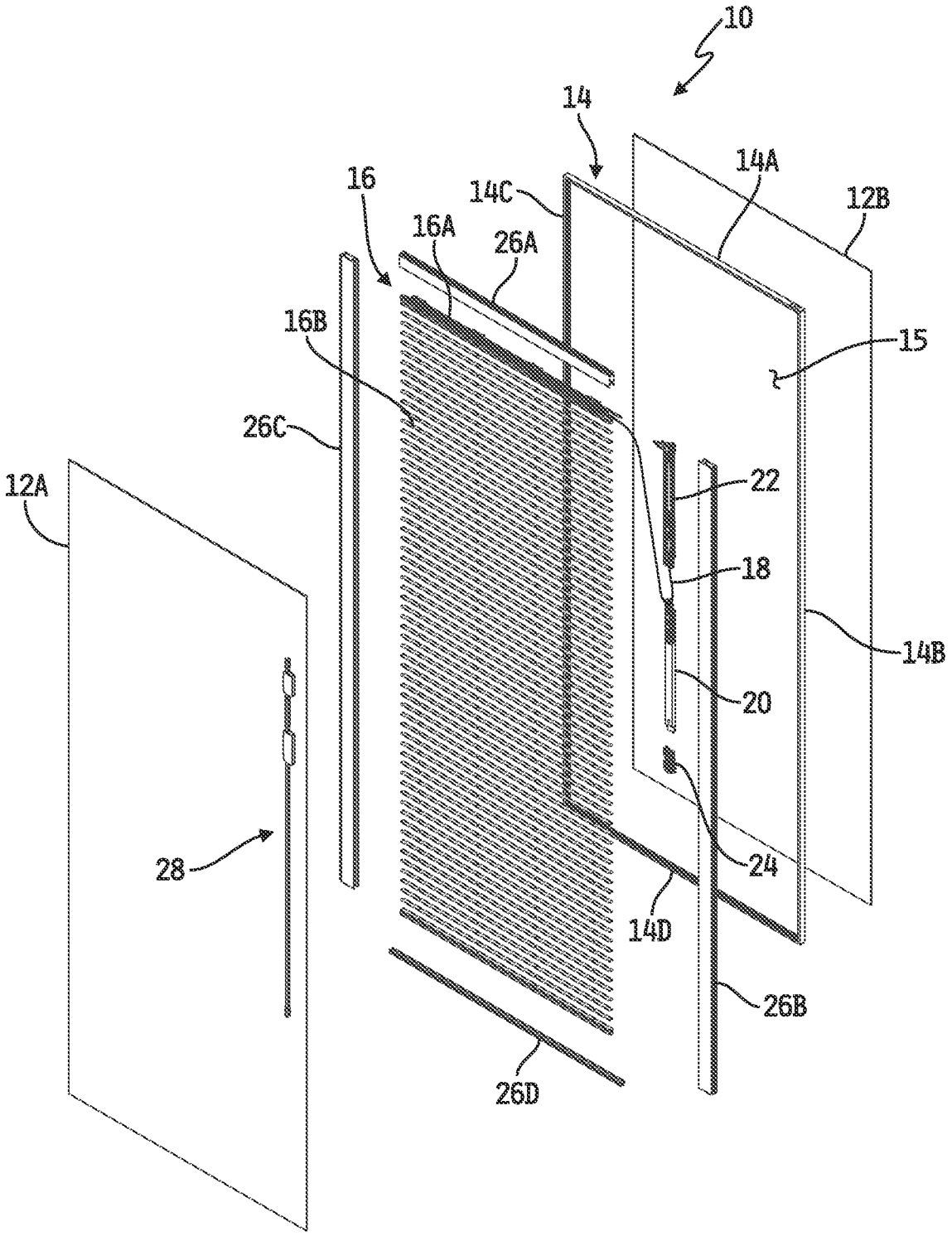
FIG. 1B is an assembly view of the panel unit of FIG. 1A.
Figure 1C:
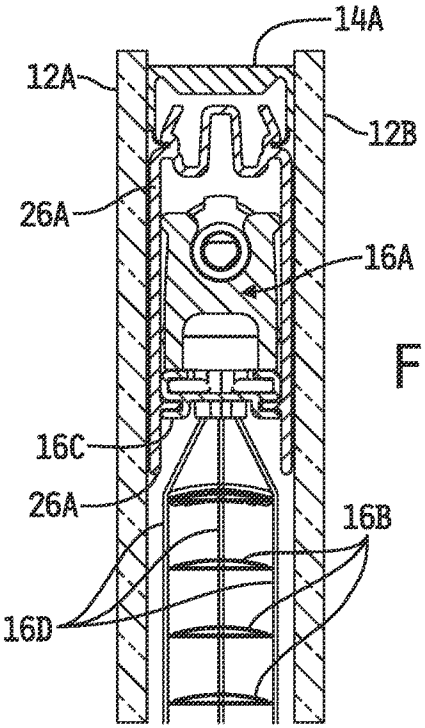
FIG. 1C is a cross-sectional view of a portion of the panel unit of FIG. 1A as viewed along section lines 1C-1C.
Figure 1D:
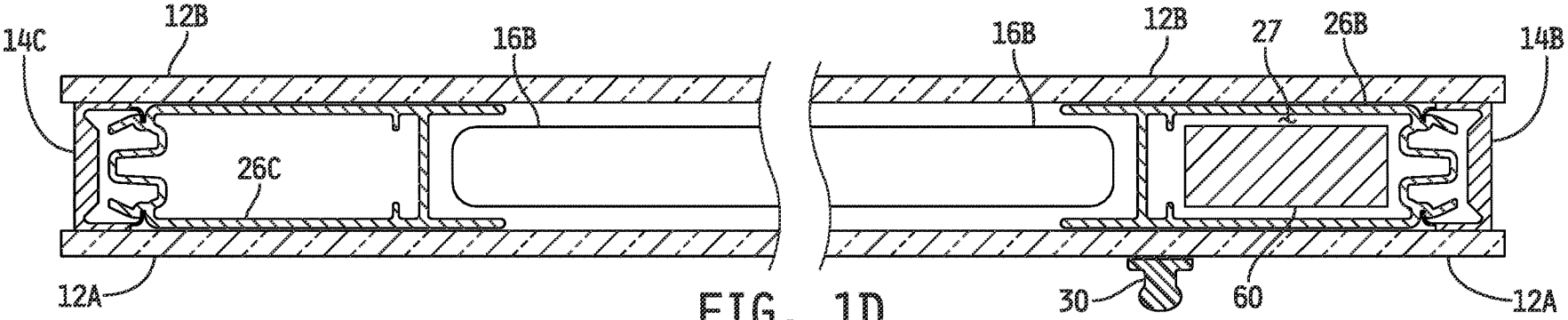
FIG. 1D is a cross-sectional view of another portion of the panel unit of FIG. 1A as viewed along section lines 1D-1D.

As also depicted in FIGS. 1A, 1B and 1D, an elongated track assembly 28 is mounted to an outer surface of the panel 12A such that the track assembly 28 is positioned over a portion of the side fascia 26B. The track assembly 28 illustratively includes an elongated track 30 secured to the outer surface of the panel 12A, and coupling members 32A, 32B and 32C are mechanically fastened to the track 30. A tilt operator assembly 34 is configured to engage the track 30 between the coupling members 32A and 32B, and a raise/lower operator assembly 36 is configured to engage the track 30 between the coupling members 32B and 32C. Both of the operator assemblies 34, 36 are configured to move relative to and along the track 30. The coupling members 32A, 32B, 32C are configured to act as stops to the travel of the operator assemblies 34, 36 such that the tilt operator assembly 34 is movable along and relative to the track 30 between the coupling members 32A and 32B and the raise/lower operator assembly 36 is movable along and relative to the track 30 between the coupling members 32B, 32C. The operator assemblies 34, 36 are both conventional in construction and operation, and both carry one or more magnets for magnetically engaging a respective one of the magnetic tilt module assembly 22 and the magnetic follower assembly 20 respectively.

By manual movement of the tilt operator assembly 34 along the track 30 between the coupling members 32A, 32B, the tilt module assembly 22 magnetically coupled thereto is moved in like manner along the channel 27 to adjust in a conventional manner, e.g., via corresponding movement of the cord 18 and resulting actuation of conventional components carried by the mounting assembly 16A of the blind assembly 16, the tilt angle of the plurality of blind slats 16B. Similarly, by manual movement of the raise/lower operator assembly 36 along the track 30 between the coupling members 32B, 32C, the follower assembly 20 magnetically coupled thereto is moved in like manner along the channel 27 to effect in a conventional manner, e.g., via corresponding movement of the cord 18 and resulting actuation of conventional components carried by the mounting assembly 16A of the blind assembly 16, raising and lowering of the plurality of blind slats 16B within the airspace 15 defined between the panels 12A, 12B. In the fully raised or near-fully raised position of the blind assembly 16, the follower assembly 20 is configured such that one or more magnets mounted to the magnetic stack latch assembly 24 magnetically engage(s) a lower portion of the follower assembly 20 (as will be described in greater detail with respect to FIGS. 1A-2D) in order to prevent the follower assembly 20, and thus the bottom end of the plurality of slats 16B, from moving downwardly in the absence of intended, manual movement of the raise/lower operator assembly 36 (also known as blind creep).

Figure 2A:
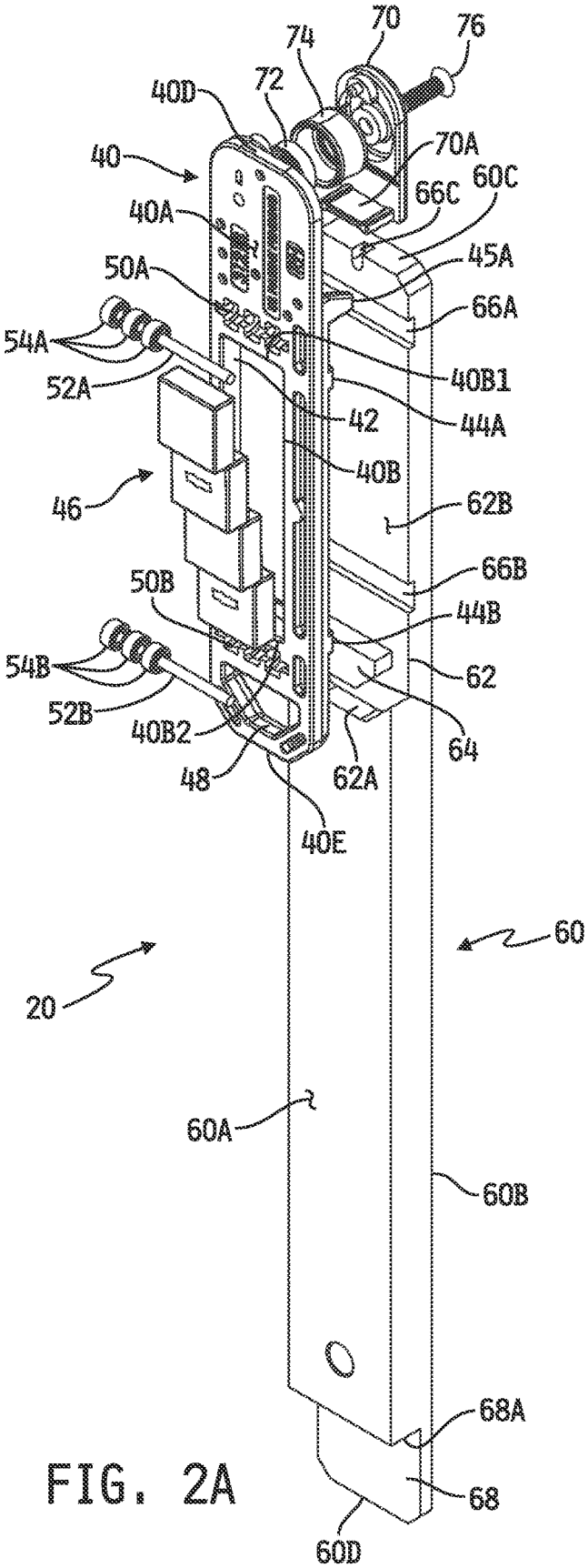
FIG. 2A is a front perspective assembly view of an embodiment of the magnetic follower assembly shown in FIG. 1B as part of the illustrated panel unit.
Figure 2B:
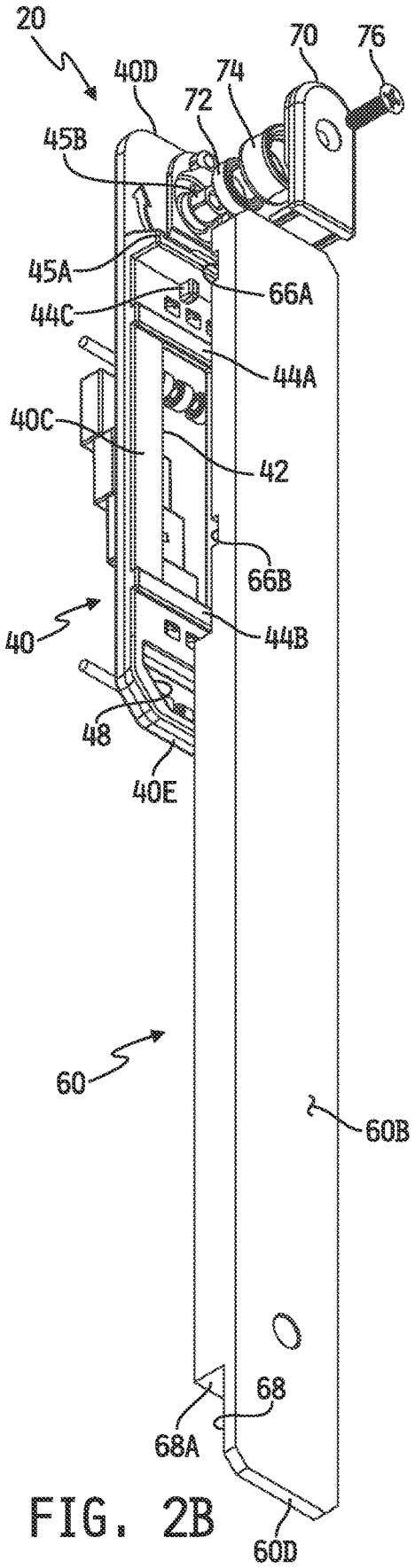
FIG. 2B is a rear perspective assembly view of the magnetic follower assembly shown in FIG. 2A.
Figure 2C:
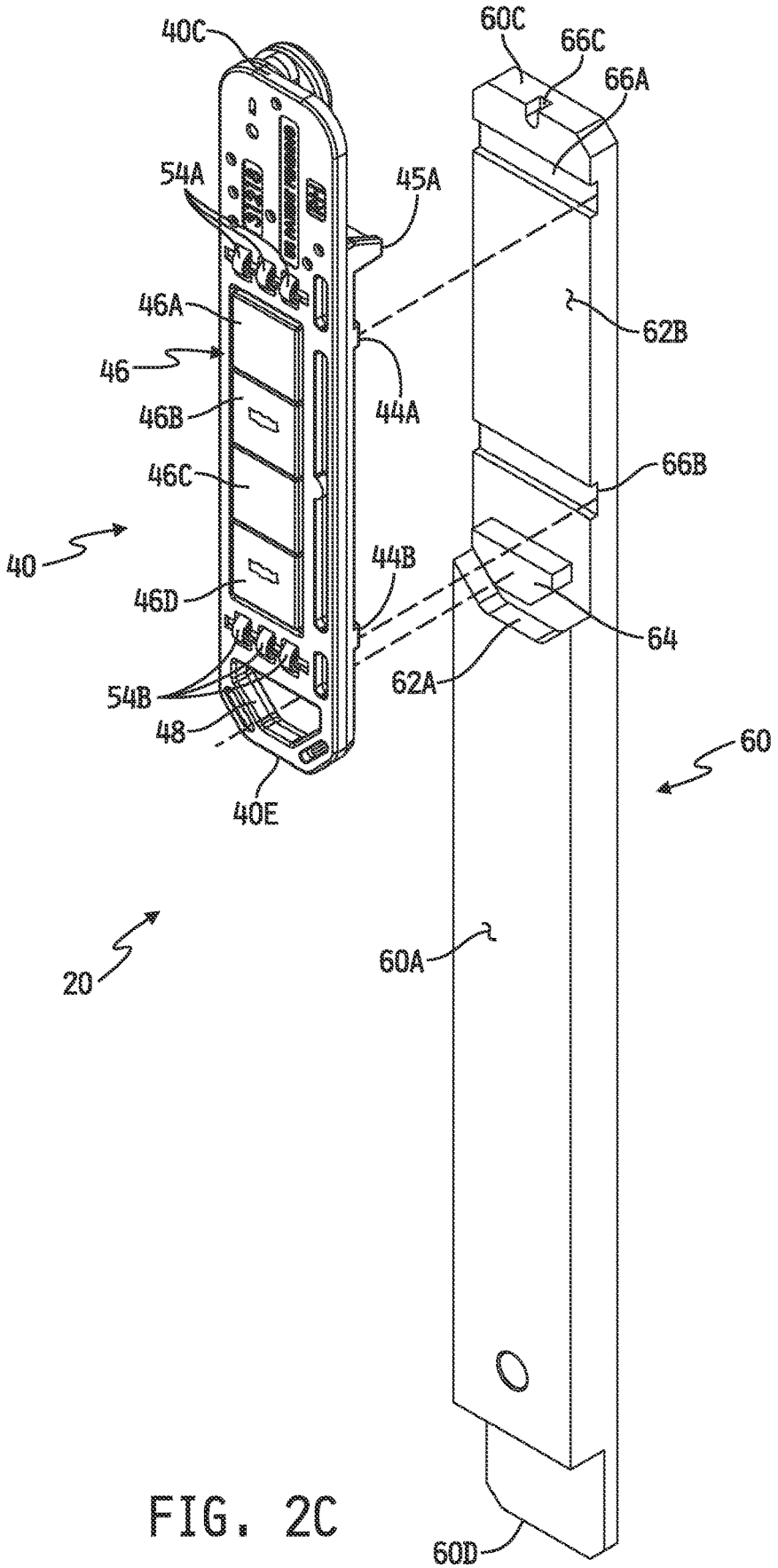
FIG. 2C is a front perspective, partial assembly view of the magnetic follower assembly of FIGS. 2A and 2B.
Figure 2D:
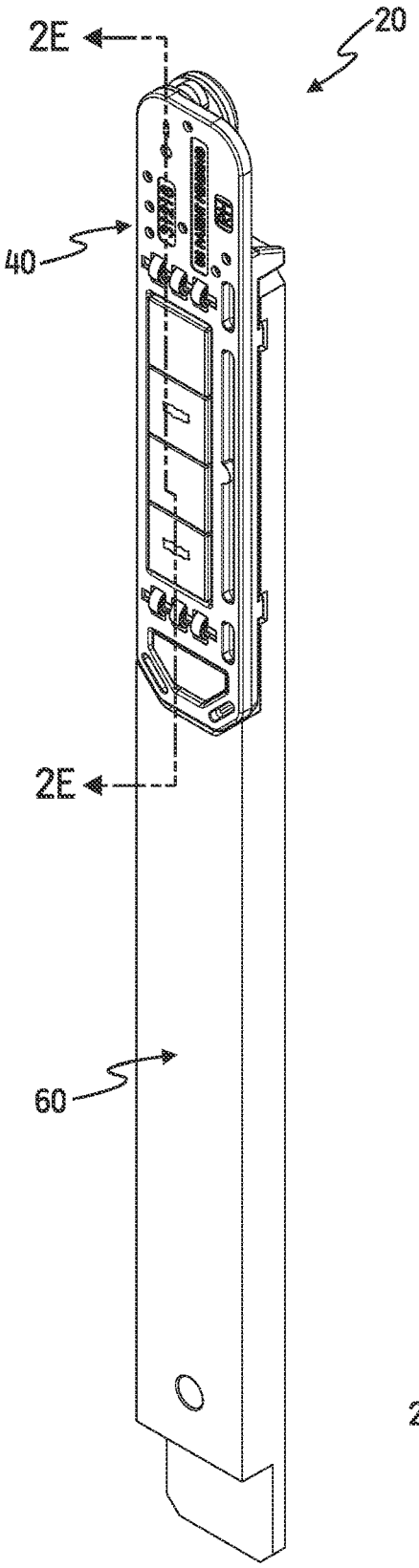
FIG. 2D is a front perspective assembled view of the magnetic follower assembly of FIGS. 2A-2C.

Referring now to FIGS. 2A-2E, an embodiment is shown of the follower assembly 20 depicted in FIGS. 1A and 1B and briefly described above. The follower assembly 20 illustratively includes an elongated follower housing 40 configured to receive one or more magnets 46 and a counterweight 60 to which the follower housing 40 is magnetically attached via the one or more magnets 46. In the illustrated embodiment, the elongated follower housing 40 is generally rectangular in shape having long sides disposed generally vertically between a top 40D of the housing 40 and a bottom 40E of the housing 40, and short sides disposed generally horizontally. The housing 40 illustratively defines an opening 40B therethrough extending from a front surface 40A of the housing 40 through a rear or back surface 40C of the housing. The opening 40B is illustratively rectangular in shape having vertically disposed, opposing long or longitudinal sides generally parallel with the long sides of the housing 40 and having horizontally disposed opposing short or transverse sides 40B1, 40B2 generally parallel with the short sides of the housing 40. A wall or flange 42 extends rearwardly from the front surface 40A of the housing 40 about a periphery of the opening 40B. Inwardly-facing surfaces of the wall or flange 42 are illustratively flush with the respective sides of the opening 40B such that the inwardly-facing surfaces of the wall or flange 42 define peripheral sides of the opening 40B. A horizontally disposed, i.e., transverse, upper bottom wall 44A extends transversely across the opening 40B from the rear terminal ends of the wall or flange 42 at and adjacent to the top transverse side 40B1 of the opening 40B, and another horizontally disposed, i.e., transverse, lower bottom wall 44B extends transversely across the opening 40B from the rear terminal ends of the wall or flange 42 at and adjacent to the bottom transverse side 40B2 of the opening 40B. The upper and lower bottom walls 44A, 44B each extend over a portion of the rear entrance to the opening 40B with inwardly-facing edges of each facing one another as best shown in FIG. 2D.

Figure 2E:
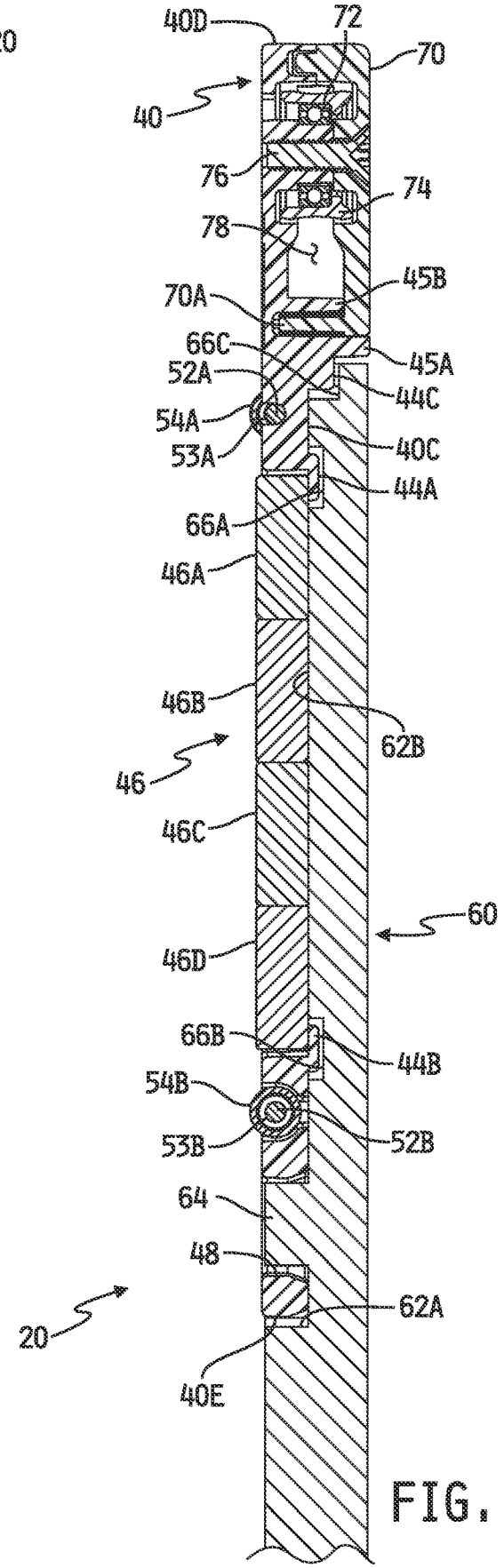
FIG. 2E is a cross-sectional view of the magnetic follower assembly of FIGS. 2A-2D as viewed along section lines 2E-2E of FIG. 2D.

At least one magnet 46 is disposed in the opening 40B of the housing 40, and is sized complementary to the opening 40B such that opposite top and bottom portions of the underside of the at least one magnet 46 are in contact with the forwardly-facing surfaces of the upper and lower bottom walls 44A, 44B respectively as best shown in FIG. 2D. In the illustrated embodiment, the at least one magnet 46 includes four separate magnets 46A-46D arranged side-by-side within the opening 40B with a top portion of the underside of the magnet 46A in contact with the forwardly-facing surface of the upper bottom wall 44A and with a bottom portion of the underside of the magnet 46D in contact with the forwardly-facing surface of the lower bottom wall 44B as also illustrated in FIG. 2E. The magnets 46A-46D are illustratively sized so as to be slidingly received side-by-side within the opening 40B such that the longitudinal sides of the resulting stack of magnets 46A-46D are in contact with or spaced slightly apart from the portions of the wall or flange 42 extending along the longitudinal sides of the opening 40B. It will be understood that while four magnets 46A-46D are provided in the embodiment of the follower assembly 20 illustrated in FIGS. 2A-2D, alternate embodiments may include more or fewer magnets with the resulting collection of magnets together (or singly) sized to substantially fill the opening 40B of the housing 40 and to be in contact with the forwardly-facing surfaces of the upper and lower bottom walls 44A, 44B as described above.

The front surface 40A of the housing 40 further defines a number of openings 50A therein spaced apart from but adjacent to the top transverse side 40B1 of the opening 40B. The openings 50A are illustratively arranged side-by-side and span the width of the opening 40B, and are each sized to receive therein a wheel-shaped bearing. In the illustrated embodiment, three such openings 50A are provided, and three corresponding bearings 54A are provided, each sized to be slidingly received within a respective one of the openings 50A. An elongated shaft bore 53A (see FIG. 2D) extends transversely into the housing 40 and illustratively bisects each of the openings 50A. The bore 53A is sized to receive therein an elongated shaft 52A, and each of the bearings 54A defines a corresponding central opening sized to be received axially onto the shaft 53A therethrough. The shaft 52A is inserted through the openings of each of the bearings 54A, and the assembly is then transversely inserted into the bore 53A such that the bearings 54A, positioned in the openings 50A, are freely rotatable about the shaft 52A.

The front surface 40A of the housing 40 further defines another number of openings 50B therein spaced apart from but adjacent to the bottom transverse side 40B2 of the opening 40B. The openings 50B are illustratively arranged side-by-side and span the width of the opening 40B, and are each sized to receive therein a wheel-shaped bearing. In the illustrated embodiment, three such openings 50B are provided, and three corresponding bearings 54B are provided, each sized to be slidingly received within a respective one of the openings 50B. Another elongated shaft bore 53B (see FIG. 2D) extends transversely into the housing 40 and illustratively bisects each of the openings 50B. The bore 53B is sized to receive therein an elongated shaft 52B, and each of the bearings 54B defines a corresponding an opening sized to be received axially onto the shaft 53B therethrough. The shaft 52B is inserted through the openings of each of the bearings 54B, and the assembly is then transversely inserted into the bore 53B such that the bearings 54B, positioned in the openings 50B, are freely rotatable about the shaft 52B. It will be understood that while three sets of openings 50A, 50B and three corresponding bearings 54A, 54B are provided in the embodiment of the follower assembly 20 illustrated in FIGS. 2A-2D, alternate embodiments may include more or fewer openings 50A and corresponding bearings 54A and/or more or fewer openings 50B and corresponding bearings 54B.

In the illustrated embodiment, the housing 40 further defines a pair of protrusions 45A, 45B spaced apart from one another with each illustratively spanning the width of the housing 40 (i.e., in the transverse direction) and each extending rearwardly from the back surface 40C of the housing 40. The protrusions 45A, 45B are illustratively positioned vertically above the opening 40B and below the top 40D of the housing 40. Another protrusion 44C illustratively extends rearwardly and centrally from the back surface 40C of the housing just below the protrusion 45C. The housing 40 further defines an opening 48 therethrough adjacent to the bottom end 40E of the housing 40 such that the bearings 54B are positioned between the openings 40B and 48. The opening 48 illustratively extends through the housing 40 from the front surface 40A through the rear surface 40C. In the illustrated embodiment, the opening 48 is generally "D" shaped with the straight section of the "D" facing the opening 40B, although in alternate embodiments the opening 48 may have any desired shape. The housing 40 is illustratively formed of a non-magnetic material such as a synthetic polymer, although in alternate embodiments the housing 40 may include or be formed of a paramagnetic and/or ferromagnetic material.

The follower assembly 20 further includes an elongated counterweight 60 to which the follower housing 40 is magnetically attached via the one or more magnets 46. In the illustrated embodiment, the elongated counterweight 60 has a front major surface 60A, a rear major surface 60B opposite the front surface 60A, a top end 60C and a bottom end 60D opposite the top end 60C. In the illustrated embodiment, the counterweight 60 is generally rectangular in shape although in alternate embodiments the counterweight 60 may be non-rectangular in shape. A recessed portion 62 is formed in the front face 60A of the counterweight 60, and in the illustrated embodiment the recessed portion 62 extends from a step 62A, spaced apart from the top end 60C of the counterweight 60, upwardly to and through the top end 60C and spanning the width of the surface 60A of the counterweight 60. A recessed channel or notch 66C is formed centrally into the front face 62B of the recessed portion 62 adjacent to the top end 60C of the counterweight 60. A projection 64, spaced apart from the step 62A, extends forwardly away from the front face 62B of the recessed portion 62. The projection 64 is illustratively shaped complementarily to the opening 48 defined through the follower housing 40 such that the projection 64 is received within the opening 48, and the bottom end 40E of the housing 40 comes into contact with or is disposed adjacent to, the step 62A as the back side 40C of the follower housing 40 is received on the front face 62B of the recessed portion 62 as shown. In the illustrated embodiment, the projection 64 is integral with the counterweight 60, i.e., such that the body of the counterweight 60 and the projection 64 are of uniform construction, although in alternate embodiments the projection 64 may be provided separately from the counterweight 60 and attached thereto in the position, and with the orientation, illustrated in FIGS. 2A and 2C-2E.

Transverse, i.e., horizontally-disposed, recessed channels 66A and 66B are formed in the front face 62B of the recessed portion 62 and each channel illustratively spans the width of the recessed portion 62. The channel 66A is spaced apart from the top end 60C of the counterweight 60, and the channel 66B is spaced apart from the channel 66A and from the projection 64 such that the channel 66B is positioned between the projection 64 and the channel 66A, and such that the channel 66A is positioned between the channel 66B and the top end 60C of the counterweight 60. The channels 66A and 66B are illustratively shaped and positioned on the front face 62A of the recessed portion 62 complementarily to the upper and lower bottom walls 44A and 44B respectively extending transversely across the rear of the opening 40B of the follower housing 40 such that the upper bottom wall 44A is received within the channel 66A, and the lower bottom wall 44B is received within the channel 66B, as the back side 40C of the follower housing 40 is received on the front face 62B of the recessed portion 62 as shown. Another recessed portion 68 is illustratively formed in the front face 60A of the counterweight 60, and in the illustrated embodiment the recessed portion 68 extends from a step 68A, spaced apart from the bottom end 60D of the counterweight 60, downwardly to and through the bottom end 60D and illustratively spanning the width of the surface 60A of the counterweight 60.

The counterweight 60 is illustratively formed of a ferromagnetic material so as to be highly susceptible to magnetization and thus highly attracted to the magnetic field(s) produced by the one or more magnets 46. In this regard, and as briefly described above, the follower housing 40 is magnetically attached to the counterweight via the magnet(s) 46 received within the opening 40B of the follower housing 40. For example, as the back side 40C of the follower housing 40 is received on the front face 62B of the recessed portion 62 of the counterweight 60 as described above, the magnet(s) 46 positioned within the opening 40B of the follower housing 40 magnetically adhere, and thereby attach, to the front face 62B of the ferromagnetic counterweight 60. Alternatively, the back side 40C of the follower housing 40 may first be received on the front face 62B of the recessed portion 62 of the counterweight 60, and the magnet(s) 46 may thereafter be inserted into the opening 40B of the housing 40. In either case, the upper and lower walls 44A, 44B will be received within the respective channels 66A, 66B, the projection 44C will be received within the slot or channel 66C, and the projection 64 will be received within the opening 48 of the housing 40. In the illustrated embodiment, the upper and lower walls 44A, 44B serve primarily to trap the housing 40 between the magnet(s) 46 and the front surface 62A of the recessed portion 62 of the counterweight 60 to thereby magnetically secure the housing 40 to the counterweight 60, and in this regard the walls 44A, 44B act as retaining walls configured to retain the housing 40 magnetically secured between the magnet(s) 46 and the recessed portion 62 of the counterweight 60. The opening 48 and projection 64, and the projection 44C and slot or channel 66C, in addition to the walls 44A, 44B and channels 66A, 66B, serve to properly locate the housing 40 on and relative to the counterweight 60. In this regard, it will be understood that the configurations of the walls 44A, 44B, channels 66A, 66B, opening 48 and projection 64, and projection 44C and slot or channel 66C illustrated in FIGS. 2A-2E and described above represent only one example arrangement for properly locating and attaching the follower housing 40 to the counterweight 60. Those skilled in the art will recognize numerous alternate configurations of the housing 40 and/or counterweight 60 that may be used to accomplish these same goals, and it will be understood that all such alternate configurations are intended to fall within the scope of this disclosure. In some alternate embodiments, the back side 40C of the housing 40 may partially or fully cover the back side of the opening 40B. In some alternate embodiments, the counterweight 60 may be or include one or more paramagnetic materials. In some alternate embodiments, the housing 40 may include more or fewer, i.e., one or more, retaining walls configured to retain the housing 40 magnetically secured between the magnet(s) 46 and the recessed portion 62 of the counterweight 60.

In an addition to being configured for magnetic attachment thereto of the follower housing 40 as described above, the counterweight 60 illustrated in FIGS. 2A-2D serves a number of additional functions. Firstly, the counterweight 60 serves to counter, or act against, the weight of the plurality of blind slats 16B of the blind assembly 16 so as to reduce forces required to be applied by the raise/lower operator assembly 36 to the follower assembly 20 to raise and lower the blind slats 16B. Generally, the weight of the counterweight 60 required to accomplish this feature will depend, at least in part, on the weight of the blind slats 16B, which will generally be a function of the number, width and material composition of the blind slats 16B included in the blind assembly 16. As one non-limiting example in which the blind assembly 16 includes a total of 261 aluminum blind slats 16B each of length 767 mm, the counterweight 60 is sized to weigh approximately 1.3 pounds, although in other embodiments the counterweight 60 may be sized to weigh more or less than 1.3 pounds.

The counterweight 60 also illustratively serves to direct the flux of the magnet(s) 46 forwardly toward the raise/lower operator assembly 36 (see FIG. 3), and in this regard the counterweight 60 is illustratively a homogeneous structure formed of a ferromagnetic or paramagnetic material. In some alternate embodiments, the counterweight 60 may be or include one or more non-magnetic components to which one or more layers of a ferromagnetic or paramagnetic material, suitable to direct the flux of the magnet(s) 46 forwardly toward the operator assembly 36, are attached.

The counterweight 60 further serves to engage the magnetic stack latch assembly 24 positioned within the channel 27 of the side fascia 26B under certain operating conditions of the blind assembly 16 as briefly described above. In particular, the recessed portion 68 of the counterweight 60 adjacent to the bottom end 60D thereof is sized and configured to magnetically engage and attach to one or more magnets carried by the magnetic latch assembly 24 as the follower assembly 20 is moved downwardly within the channel 27 to position the blinds 16B in the fully raised or near-fully raised position of the blind assembly 16. Such magnetic engagement of the recessed portion 68 of the counterweight 60 with the magnet(s) carried by the magnetic latch assembly 24 illustratively prevents the follower assembly 20, and thus the bottom end of the plurality of slats 16B, from moving downwardly in the absence of intended, manual movement of the raise/lower operator assembly 36 (also known as blind creep). Illustratively the attractive force between the magnet(s) carried by the magnetic latch assembly 24 and the recessed portion 68 of the counterweight 60 is less than that of the attractive force between the magnet(s) 46 of the follower assembly 20 and the magnet(s) carried by the raise/lower operator assembly 36, such that the recessed portion 68 of the counterweight can be disengaged from the magnet(s) carried by the magnetic latch assembly 24 to raise the blind slats 60B via upward manual movement of the operator assembly 36 along the track 30 as described above.

A rear bearing cover 70 has a forwardly facing projection 70A positioned and configured to be received within the space defined between the projections 45A, 45B extending rearwardly from the back or rear surface 40C of the follower housing 40 as best seen in FIG. 2D. A bearing 72 is illustratively received within a bearing sleeve 74, and an elongated fixation member 76, e.g., a threaded screw or bolt, is passed through the bearing cover 70, centrally through the bearing 72 and then into engagement with a bore defined in the rear surface 40C of the follower housing so as to mount, i.e., attach, the bearing cover 70 to the follower housing 40 with the bearing sleeve 74 and the bearing 72 rotatable about the shaft of the fixation member 76. As best seen in FIG. 2D, a space 78 is defined between the combination of the bearing 72 and bearing sleeve 74 and the projection 45B. The cord 18 of the blind assembly, depicted by example in FIG. 1B, passes through the space 78 and engages the bearing sleeve 74 such that the bearing 72 and sleeve 74 rotate as the cord 18 moves through the space 78 during upward and downward movement of the follower assembly 20 under control of the raise/lower operator assembly 36 as described above and as depicted by example in FIG. 3.

Figure 2F:
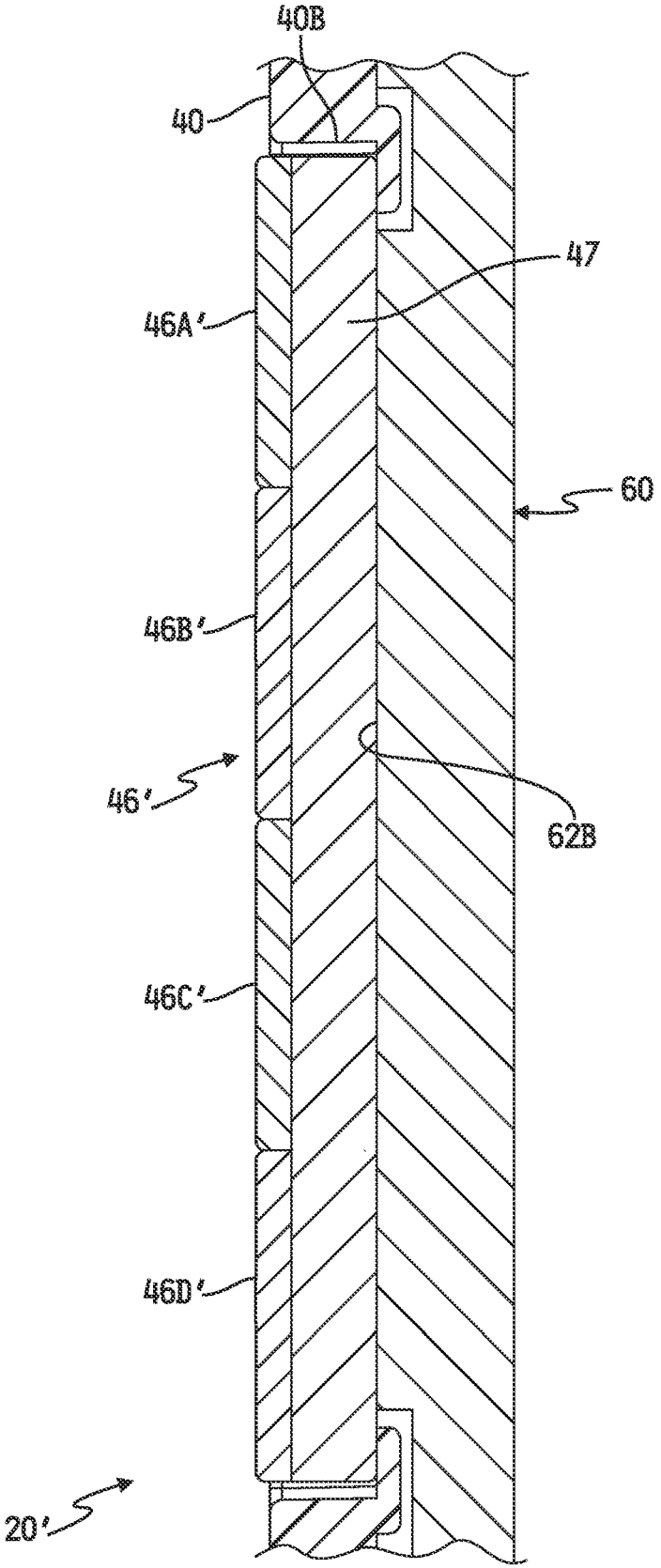
FIG. 2F is a cross-sectional view similar a portion of FIG. 2E and illustrating an alternate embodiment of the magnetic follower assembly implementing an alternate embodiment of a mounting arrangement for securing the follower housing to the counterweight.

Referring now to FIG. 2F, an alternate embodiment is shown of a portion of a follower assembly 20'. The follower assembly 20' depicted in FIG. 2F is illustratively identical to the follower assembly 20 illustrated in FIGS. 2A-2E and described above except for the mounting of the housing 40 to the counterweight 60. In the embodiment illustrated in FIGS. 2A-2E, for example, the one or more magnets 46 act as a retaining member(s) which traps, via magnetic attractive forces, the upper and lower bottom walls 44A, 44B of the housing 40 between the one or more magnets 46 and the counterweight 60 as described above. In the embodiment illustrated in FIG. 2F, in contrast, a retaining plate 47 is received within the opening 40B defined through the housing 40 and attached, e.g., via a conventional boding medium and/or via one or more conventional mechanical fixation members, to the face 62B of the counterweight 60. In this embodiment, the retaining plate 47, attached to the counterweight 60 as just described, acts to trap the upper and lower bottom walls 44A, 44B of the housing 40 between the retaining plate 47 and the counterweight 60 to thereby secure the housing 40 to the counterweight. In some embodiments, the retaining plate 47 may be provided in the form of a single structure, and in alternate embodiments the retaining plate 47 may be formed of interconnected plate members. In any case, at least one magnet 46', reduced in thickness relative to the magnet(s) 46 illustrated in FIGS. 2A-2E, is attached to the exposed face of the retaining plate 47. Four such magnets 46A', 46B', 46C' and 46D' are shown in FIG. 2F, although it will be understood that in alternate embodiments more or fewer such magnets may be used. In one embodiment, the retaining plate 47 is formed of a ferromagnetic or paramagnetic material, and the one or more magnets 46' is/are attached to the retaining plate 47 via magnetic attractive forces as described above. In alternate embodiments, the retaining plate 47 may be formed of a non-ferromagnetic or non-paramagnetic material, e.g., polymer, or other material, and the one or more magnets 46' is/are attached to the retaining plate 47 via a conventional boding medium and/or via one or more conventional mechanical fixation members.

Referring now to FIG. 3, a magnified and partial cutaway view is shown of the portion M of the panel assembly 10 illustrated in FIG. 1A. The raise/lower operator assembly 36 illustratively includes a housing 36A configured to slidingly engage the track 30 such that the housing 36A is slidable upwardly and downwardly along the track 30 in a conventional manner. One or more magnets 80 is/are mounted to and carried by the housing 36A and generally face the magnet(s) 46 carried by the follower housing 40. The housing 36A is generally positioned such that the magnet(s) 80 is/are juxtaposed with the magnet(s) 46 so as to magnetically engage the operator assembly 36 with the follower assembly 20 through the panel 12A and side fascia 26B as shown and as is conventional. As the raise/lower operator assembly 36 is moved upwardly and downwardly along the track 30, the follower assembly 20 is correspondingly moved along the channel 27 via the magnetic engagement between the magnet(s) 80 carried by the operator assembly housing 36A and the magnet(s) 46 carried by the follower housing 40. As the follower assembly 20 moves along the channel 27, the bearings 54A, 54B roll along the inner surface of the side fascia 26A thereby facilitating movement of the follower assembly 20 along the channel 27 in a conventional manner. As the follower assembly 20 moves upwardly and downwardly along the channel 27, the cord 18 passing through the follower assembly 20 respectively raises and lowers the blind slats 16B also in a conventional manner.

While this disclosure has been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected.

What is claimed is:

1. A follower arrangement, operatively coupled to a plurality of slats of a blind assembly via a flexible cord, for raising and lowering the plurality of slats via the flexible cord, the follower arrangement comprising:

a housing defining a first opening therethrough, a ferromagnetic or paramagnetic counterweight to act against a weight of the plurality of slats of the blind assembly to reduce forces required to be applied to the follower arrangement to raise or lower the slats, and at least one magnet received within the first opening defined through the housing and magnetically attached to the counterweight to magnetically secure the housing to the counterweight.

2. The follower arrangement of claim 1, wherein the housing defines a second opening configured to receive the flexible cord therethrough.

3. The follower arrangement of claim 2 further comprising a cover mounted to the housing, the second opening defined between the cover and the housing.

4. The follower arrangement of claim 3, further comprising a first bearing assembly rotatably mounted between the cover and the housing, the bearing assembly configured to contact the flexible cord and rotate relative to the cover and the housing in response to movement of the flexible cord through the second opening.

5. The follower arrangement of claim 1, further comprising at least one bearing at least partially received within the housing, the at least one bearing rotatably mounted to the housing and configured to rotate relative to the housing in response to movement of the housing relative to a surface in contact with the at least one bearing.

6. The follower arrangement of claim 1, wherein the counterweight defines a mounting face to which the at least one magnet is magnetically attached, and wherein the counterweight defines a projection extending outwardly away from the mounting face of the counterweight, and wherein the housing defines a third opening therethrough configured to receive the projection therein for positioning the housing and the counterweight relative to one another.

7. The follower arrangement of claim 1, wherein the counterweight has an elongated body extending between top and bottom ends thereof, and wherein the counterweight defines a mounting face adjacent to a top end of the elongated body to which the at least one magnet is magnetically attached.

8. The follower arrangement of claim 1, wherein at least one magnet has a mounting face and an exposed face opposite the mounting face of the at least one magnet, and wherein the counterweight defines a mounting face to which the mounting face of at least one magnet is magnetically attached, and wherein the counterweight comprises a homogeneous structure formed of the ferromagnetic or paramagnetic material to direct magnetic flux produced by the at least one magnet outwardly away from the exposed face of the at least one magnet.

9. The follower arrangement of claim 1, further comprising at least one retaining wall disposed over at least a portion of the first opening defined through the housing, wherein the at least one retaining wall is positioned between the at least one magnet and the counterweight such that magnetic attachment of the at least one magnet to the counterweight secures the housing between the at least one magnet and the counterweight.

10. A panel assembly, comprising:

first and second spaced apart panels, a spacer affixed to inner surfaces of each of the first and second panels about a periphery of the first and second panels to define an air space bounded by the spacer and the first and second panels, a blind assembly, including a plurality of blind slats, disposed within the air space and operatively coupled to the spacer, a flexible cord operatively coupled to the blind assembly for raising and lowering the plurality of blind slats, and the follower arrangement of claim 1 operatively coupled to the flexible cord.

11. The panel assembly of claim 10, further comprising an elongated fascia coupled to and extending along one side of the first and second panels, the elongated fascia defining a channel therein, and wherein the follower arrangement is disposed within and movable along the channel defined in the elongated fascia.

12. The panel assembly of claim 11, further comprising an operator assembly movably coupled to and along an exterior surface of the first or second panel, the operator assembly carrying at least one magnet facing and magnetically coupled through the elongated fascia to the at least one magnet of the follower arrangement, the follower arrangement movable along the channel defined in the elongated fascia via movement of the magnetically coupled operator assembly along the exterior surface of the elongated fascia.

13. The panel assembly of claim 12, wherein at least one magnet of the follower arrangement has a mounting face and an exposed face opposite the mounting face of the at least one magnet of the follower arrangement, the exposed face of the at least one magnet of the follower arrangement facing the at least one magnet of the operator assembly, and wherein the counterweight of the follower assembly defines a mounting face to which the mounting face of at least one magnet of the follower arrangement is magnetically attached, and wherein the counterweight comprises a homogeneous structure formed of the ferromagnetic or paramagnetic material to direct magnetic flux produced by the at least one magnet of the follower arrangement outwardly away from the exposed face of the at least one magnet of the follower arrangement.

14. The panel assembly of claim 10, wherein the follower arrangement further includes a cover mounted to the housing, the cover and the housing defining a second opening therebetween configured to receive the flexible cord therethrough.

15. The panel assembly of claim 10, wherein the follower arrangement further includes at least one bearing at least partially received within the housing, the at least one bearing rotatably mounted to the housing and configured to rotate relative to the housing and relative to the elongated fascia in response to movement of the housing along the channel defined in the elongated fascia.

16. A follower arrangement, operatively coupled to a blind assembly via a flexible cord, for raising and lowering a plurality of slats of the blind assembly via the flexible cord, the follower arrangement comprising:

a housing defining a first opening therethrough, at least one retaining wall disposed over at least a portion of the first opening, a counterweight to act against a weight of the plurality of slats of the blind assembly to reduce forces required to be applied to the follower arrangement to raise or lower the slats, and at least one retaining member received within the first opening defined through the housing and abutting the at least one retaining wall, the at least one retaining member attached to the counterweight to secure the housing between the retaining member and the counterweight.

17. The follower arrangement of claim 16, wherein the at least one retaining member has a mounting face and an exposed face opposite the mounting face of the at least one retaining member, and wherein the mounting face of the at least one retaining member is attached to the counterweight.

18. The follower arrangement of claim 17, wherein the at least one retaining member includes at least one magnet, and wherein the counterweight is formed of a ferromagnetic or paramagnetic material, and wherein the mounting face of the at least one magnet is magnetically attached to the counterweight to trap the at least one retaining wall between the at least one magnet and the counterweight.

19. The follower arrangement of claim 17, wherein the at least one retaining member includes:

a retaining plate having a first face defining the mounting face of the at least one retaining member and a second face opposite the first face, wherein the first face of the retaining plate is attached to the counterweight to trap the at least one retaining wall between the retaining plate and the counterweight, and at least one magnet attached to the second face of the retaining plate.

20. The follower arrangement of claim 16, wherein the housing is configured to operatively couple to the flexible cord.

* * * * *